US005575118A

United States Patent [19]

Vahldieck

[11] Patent Number: 5,575,118

[45] Date of Patent: Nov. 19, 1996

[54] EAVES TROUGH ASSEMBLY

[76] Inventor: Wayne Vahldieck, 88-A Grand Blvd., Massapequa Park, N.Y. 11762

[21] Appl. No.: 426,871

[22] Filed: Apr. 24, 1995

[51] Int. Cl.[6] ..... E04D 13/00

[52] U.S. Cl. ..... 52/11; 52/12; 248/48.1; 248/48.2

[58] Field of Search ..... 52/11, 12; 248/48.1, 248/48.2

[56] References Cited

U.S. PATENT DOCUMENTS

| | | | |
|---|---|---|---|
| 836,012 | 11/1906 | Cassen | 52/11 |
| 2,672,832 | 3/1954 | Goetz | 52/11 |
| 2,873,700 | 2/1959 | Heier | 52/11 |
| 3,864,882 | 2/1975 | Lasscock | 52/11 |
| 4,493,588 | 1/1985 | Duffy | 52/12 X |
| 4,497,146 | 2/1985 | Demartini | 52/12 |
| 4,757,649 | 7/1988 | Vahldieck | 52/12 |
| 5,189,849 | 3/1993 | Collins | 52/12 |

*Primary Examiner*—Creighton Smith
*Assistant Examiner*—David J. Jersen
*Attorney, Agent, or Firm*—Ancel W. Lewis, Jr.

[57] ABSTRACT

A trough with superimposed shield to reject leaves and allow water to enter the trough include a bracket which supports the shield and the trough and which rests on a back wall of the integral shield and trough. The front of the shield ends in a backward facing upturned curve for engaging the bracket. The front of the trough ends in a backward facing downturned curve for engaging the bracket.

19 Claims, 3 Drawing Sheets

EAVES TROUGH ASSEMBLY

BACKGROUND OF THE INVENTION

1. Field of the Invention

This invention relates to a rain gutter system for receiving water run-off and rejecting leaves and other debris and, more particularly, to shielded eaves troughs and to a bracket which is form-retaining and supports the shielded trough on the building and which may also be used to fasten the trough to the building.

The invention is specifically directed to an improved gutter and leaf shield system in which the rain water runs faster than in prior art gutters because of added rain run-off capacity and in which the gutter and integral leaf shield is better suited to continuous roll forming and the bracket implements form retaining of and support for the added material required to increase rain water run-off.

2. Description of the Prior Art

There are several patented designs of shielded eaves troughs and brackets for supporting them on a building, some of which are described in the patents discussed below.

In my patent, U.S. Pat. No. 4,757,649, incorporated herein by reference, I disclose an integral gutter and leaf shield in which the shield is formed with a double-curved convolute to direct rain into the trough. I fastened the integral shield and gutter to the wall beneath the roof by a fastener which passed through the integral back wall to the building wall.

U.S. Pat. No. 836,012, patented by G. Cassen, Nov. 13, 1906, describes a trough having a back wall that is higher than the front wall. A separate shield which extends from the top of the back wall slopes forward and downward. The front of the shield turns downward, ending just rearward of the top edge of the front wall. A pair of brace straps attach the shield and trough to the building at intervals along the length of the trough.

One of the braces is a strap attached at one end to the top of the front of the shield, and at the other end to the top of the roof. The other brace is a bar attached at one end to the back wall of the trough by a screw which passes through the bar, the trough wall and the vertical side wall of the building. The other end of the bar is bifurcated to provide an upturned and a downturned attachment tab. The upturned tab is attached to the front end of the shield, and the downturned tab is attached to the trough by the top edge of the front wall.

U.S. Pat. No. 2,672,832, patented Mar. 23, 1954 by A. K. Goetz, describes a trough having a back wall higher than the front wall. The top of the back wall has a V-shaped longitudinal, horizontally arranged groove. The rear edge of the shield has a matching groove so that the rear edge can seat on the back wall groove.

A pair of nails attach the shield and trough, respectively, to the building. The first nail has a threaded back end and passes through the back wall and into the vertical side wall of the building. A screw which passes through the downward turned front of the shield engages the threaded back end of the nail and forces the shield toward the building wall so that the shield is seated on the back wall groove. The nail arrangement is repeated at intervals along the length of the shield and trough assembly. The shield may be removed for cleaning the trough by removing the screws.

The second nail is through the front end of the trough and into the side wall of the building. An elongated tubular spacer on the nail prevents collapsing of the trough when the second nail is hammered into the side wall.

U.S. Pat. No. 2,873,700, patented Feb. 17, 1959 by H. C. Heier, describes a trough having a back wall that is higher than the front wall. A generally flat rearward section of the shield extends forward from the top of the back wall. Angling slightly downward, it extends forward of the front wall and ends just rearward of the front wall. The ends of the trough and shield sections are interconnected by brackets which are fastened to the wall of the building by screws.

A series of the spacers along the length of the shielded trough assembly provides slot openings to the trough for receiving water that moves down over the shield. The front end of the shield is fastened to the top of the front wall of the trough by way of a screw through the shield, through a wedge-shaped spacer between the shield and front wall and through the front wall.

U.S. Pat. No. 4,493,588, patented by G. Duffy, Jan. 15, 1985, describes a trough having a back wall which is nailed to a roof under the shingles, extends forward and down from the roof in a curve that then turns back under the eaves, whereupon the wall reverses direction and forms a suspended trough, the front wall of which has a screen that contacts the front of the curved back wall just below the forwardmost part of the curve, so that water flowing down over the curve enters the trough via the screen.

A strap is attached by one end to the rear surface of the back wall near the bottom of the inward turned curve over the trough and attached by the other end to the eaves soffit.

U.S. Pat. No. 4,497,146, patented Feb. 5, 1985 by R. Demartini, describes a support strap having one end resting on the roof of the building. In juxtaposed support with the underside of a separate shield which is retrofitted on already installed gutters. The strip extends forward from the roof until it is about parallel with the front wall of the trough. The strip then curves back with the shield until it reaches the bottom end of the shield, whereupon the strip continues downward and is fastened to the upper part of the front wall of the trough, in order to support the shield on the trough. It is fastened to the trough either directly by a fastener or indirectly by attachment to the ferrule of a horizontal bolt that passes through the front and back walls of the trough normal to the back wall of the trough and into the vertical side wall of the building.

SUMMARY OF THE INVENTION

It is one object of the invention to provide an improved shielded trough for the eaves of a building incorporating the inventions of my prior patent, U.S. Pat. No. 4,757,649, but which has greater rain water run-off capacity.

It is another object to provide an integrally formed bracket for the shielded trough which both conforms to and supports the form of the shield at extended lengths of the shielded trough and supports the trough as well instead of supporting the shield on the trough or the trough from the shield.

It is another object that the form conforming and support bracket be enclosed within the shielded trough.

It is another object that the form supporting bracket can be independent of fasteners that attach the shielded trough to the building.

It is another object that the form supporting bracket can be independent of fasteners.

It is another object that the form supporting bracket can alternatively be fastened to the wall of the building by a fastener through the back of the shielded trough while in place within the shielded trough.

It is another object of the invention that the form supporting bracket can be easily moved along the length of the shielded trough within the shielded trough.

It is yet another object that the form supporting bracket can be moved the length of the shielded trough, even though the trough may be installed on a building.

It is still another object that the form supporting bracket can be moved along within the shielded trough by applying through the longitudinal opening in the front of the shielded trough, urging force against the supporting bracket.

It is still another object that the form supporting bracket can be a single piece unitary molded construction.

Other objects and advantages will be apparent to one reading the ensuing description.

In designing the shielded trough of the invention, I extended the flat bottom of the gutter of my patented leaf rejecting gutter into an upwardly concave section to increase the capacity of the gutter. I also extended and bent the lips of the trough and of the shield inwardly, both for the sake of safety and to enhance the rain gathering functions of the shield and trough.

Consequently, the design which already includes a shield, downwardly concave, double convolute in cross section proved easier to fabricate from sheet material, such as aluminum, through continuous rolling processes.

However, the addition of material also resulted in added weight and extended lengths of the shielded trough tended to bend intermediate their ends.

I, therefore, conceived of a bracket for the new shielded trough which could be located inside the shielded trough anywhere along the length of the shielded trough. I also redesigned the top of the shielded trough to accept fasteners externally of the shielded trough so that the bracket need not be secured to the building by fasteners extending through the back of the trough. I also designed the bracket with an extension so that alternatively it could be fastened to the building through the back of the shielded trough.

The new and improved shielded trough and bracket combination comprises a shield trough having a back wall which is supported against the wall of the building beneath the roof, an upwardly concave a trough integral with the back wall, a shield integral with the back wall and extending forward over the trough so that leaves are deflected from entering an opening between the front of the shield and the front wall of the trough to the interior of the shielded trough and so that water flowing over the shield enters the opening and into the trough; a bracket comprising a first wall in mating juxtaposed support with the inner side of the shield, a second wall having a back end extending from the back end of the first wall in the back of the shielded trough assembly, a front end of the second wall being in mating juxtaposed support with the formed upper end of the front wall of the trough.

A first bracket arm extends from the under side of the second wall and rests against the back wall of the shielded trough. It extends from the second wall between and spaced from the front and back ends of the second wall.

A bracket arm extends from the top side of the second wall and connects to the under side of the first wall.

In a preferred embodiment of the invention, a lateral extension from the back end of the first bracket arm provides a fastener receptor for fastening the bracket to the building wall and is accessible through the opening between the front of the trough and shield.

The bracket may freely slide within the shielded trough by applying sideways force to the bracket.

The front end of the first wall of the bracket ends in a backward facing upturned bend for engaging the backward facing upturned bend of the front of the shield.

The front of the trough ends in a backward facing downturned bend for engaging the backward facing downturned bend of the front end of the second wall of the bracket.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
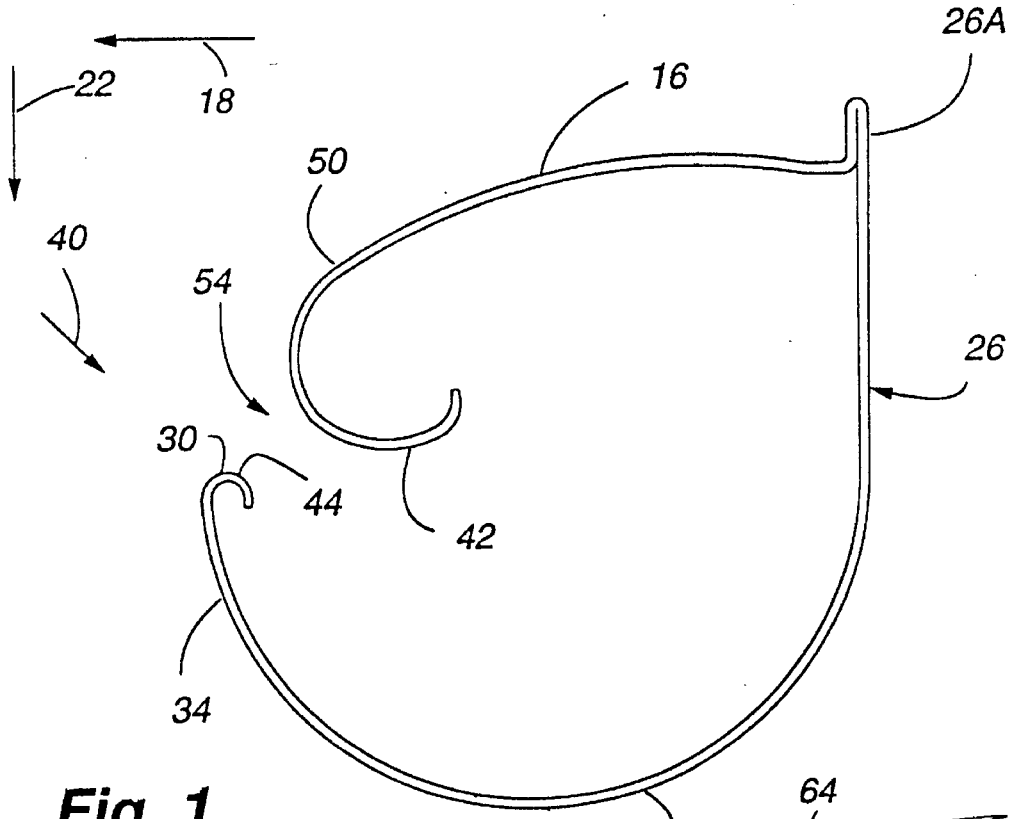
FIG. 1 is a diagrammatic side view of a shielded trough according to the invention.
Figure 2:
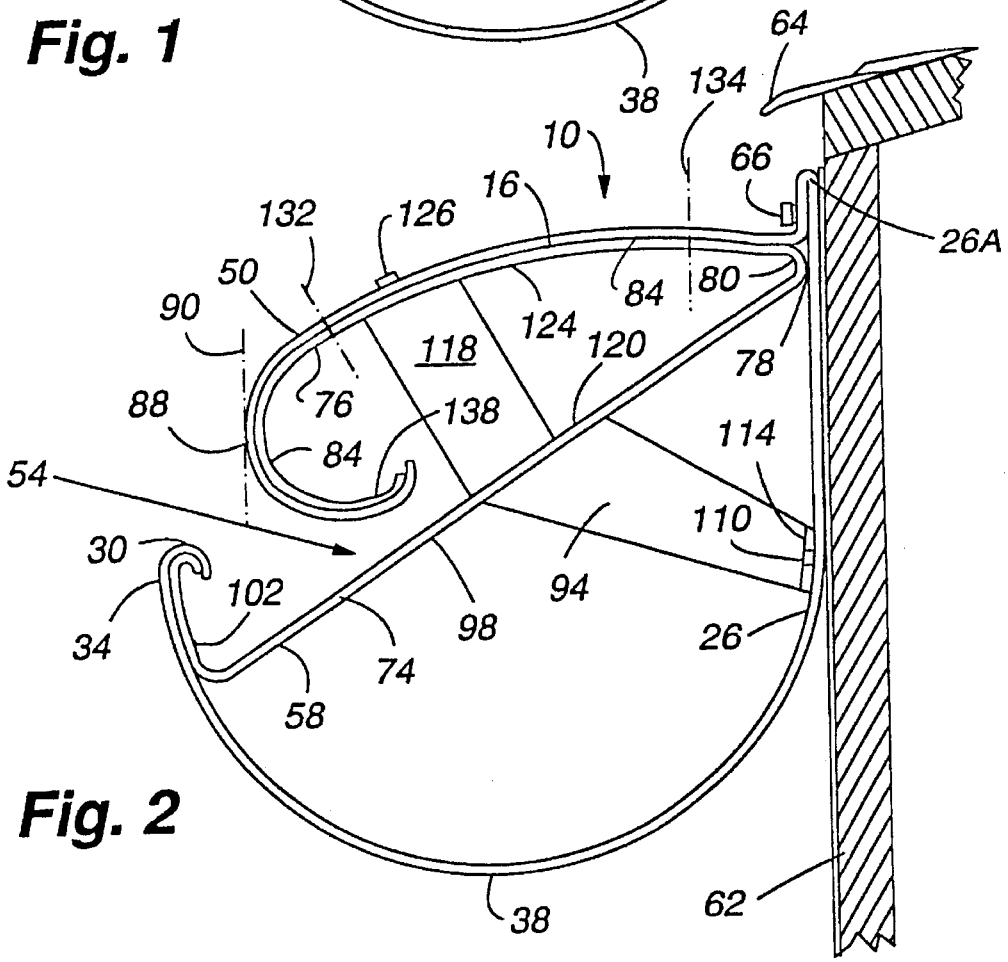
FIG. 2 is a diagrammatic side view of the shielded trough of FIG. 1 and a form supporting bracket, according to the invention.
Figure 3:
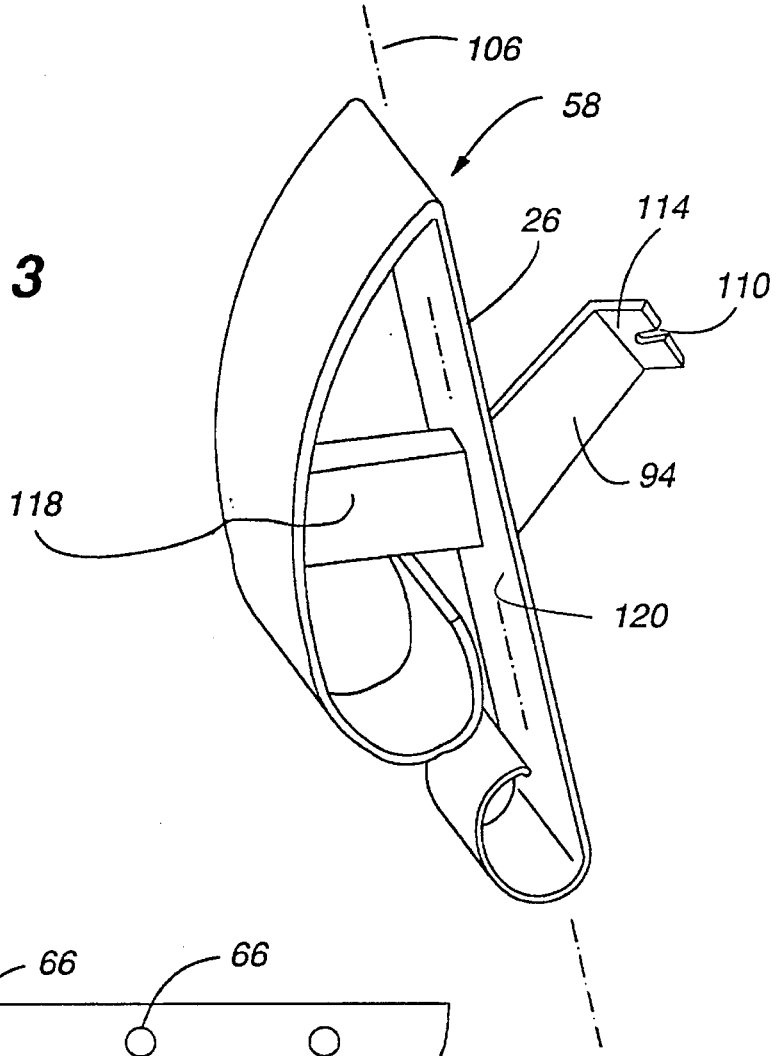
FIG. 3 is a rotated perspective view taken from 2 o'clock high, of the bracket of FIG. 2.
Figure 4:
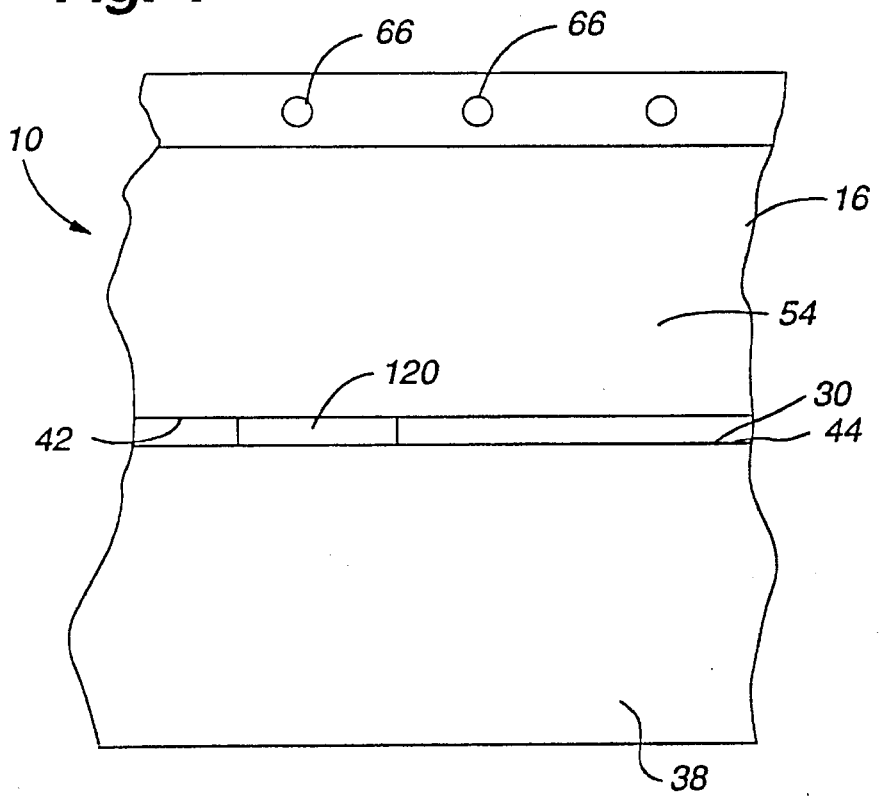
FIG. 4 is a front view of the shielded trough of FIG. 1 showing a portion of the form supporting bracket of FIG. 2 installed.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1, 2, 3 and 4, the integrally formed shielded trough 10 may be supplied in a length of choice. This may be 5', 10', 20' or any length desired, including as a continuous run from a roll forming machine on a construction site.

Shielded trough 10 includes shield 16 which is formed as a double convolute which extends forward (arrow 18) and downward (arrow 22) from the back wall 26 and continues around to a low point 42 that is rearward of the high point 44 of top 30 of the front wall 34. The front end 42 of the shield is curved inwardly and rearwardly and then upwardly to eliminate a sharp edge at the front of the shield.

Top 30 of front wall 34 of trough 38 is preferably curved inward (arrow 40).

Preferably, the front 50 of the shield extends forwardly enough so that leaves and debris moving down over shield 16 continues past opening 54 to the interior of shielded trough 10.

Preferably the downward slope and curve of the double curve convolute of the shield is such that water running down over the shield flows into opening 54 and is captured in trough 38 for runoff into a downspout (not shown).

The upwardly concave shape of the trough portion of the shielded trough represents an enlargement of the trough to increase capacity and that shape and the downward curve of the top of the front wall eliminates sharp bends at the front and back of the assembly for easier fabrication; i.e., to reduce the length and cost of roll forming machinery.

The form or shape of a shielded trough which contributes to collecting water and rejecting leaves and debris must be maintained over the length of the shielded trough in order to maintain its efficiency. Loss in the effective form at some place along the length of the assembly can result in damming the trough at that place and, in any event, in weakening the installed structure.

Bracket 58 supports the form of shielded trough 10 which may be attached to side wall 62 below the overhang of shingles 64, by a series of fasteners 66 spaced along the bended length of the shielded trough and extending through top vertical flange 26*a* formed by a 180 degree bend of the top end of the back wall 26 and back end of the shield.

The shielded trough and the form supporting bracket may be made of sheet metal or molded of plastic. It is preferred that the bracket be of one piece unitary plastic construction for sake of economy and resilience against bending forces which may be applied during installation of the bracket within the shielded trough.

Bracket 58 includes wall 74 which, at its front end 102 conforms to and is in mating juxtaposed relation with the inner curved surface of the top 30 of front wall 34 to support the trough 38 which is formed at that location as a rounded lip. Bracket wall 74 extends rearward and upward until it joins wall 76 at junction 80 close to the inside of bended flange 26*a* at the integral junction 78 of back wall 26 of shielded trough 10 and shield 16. Wall 76 extends forward in mating juxtaposed support with the inner side of shield 16 continuously in close support of the shield through the most forward point 88 of the front 50 of shield 16, as defined by a vertical tangent 90 to the front of the shield and around the inner surface of the curved front end of the shield.

Bracket arm 94 extends from bottom side 98 of wall 74, from a portion of wall 74 that is between and spaced from end 102 and turn 80 of wall 74. Bracket arm 94, being generally straight, extends obliquely to back wall 26 against which it rests to support the bracket, shield and trough.

Bracket arm 94 is preferably offset from center line 106 of back wall 26 so that a screw driver or other tool can access slot 110 in tab 114 directly through opening 54 without significant interference from wall 74, for attaching bracket arm 94 to back wall 26 and to side wall 62 by screw, nail or other fastener through slot 110, if so desired.

Bracket arm 118 extends from topside 120 of wall 74 from a portion of wall 74 that is spaced from end 102 and turn 80 of wall 74 to the inner side 124 of wall 76 at a portion of wall 76 that is between and spaced from front end 84 and the junction of the back end of wall 76 and flange 26*a*.

Shield 16 may be fastened to bracket arm 118 by screw 126 through shield 16, wall 76 and into bracket arm 118. Shield 16 may be fastened to only wall 76 by screwing through both at such locations as 132 or 134.

Preferably front wall 34 of trough 38 ends in a backward facing, downturn bend, such as a curve, which closely receives front end 102 of wall 74 that has the same turn. Preferably front end 50 of shield 10 ends in a backward facing upturned bend, such as a curve, which closely receives end 138 of wall 76 that has the same turn. This arrangement of engagements provides stable, form support for shielded trough 10 without fasteners between shielded trough 10 and form supporting bracket 58.

In the absence of need for fasteners through the bracket, bracket 58 may easily be moved to any location within the length of shielded trough 10 before and after installation of shielded trough 10 on a building wall. Normally a plurality of brackets 58 and spaced equally along the length of the trough. An installed shielded trough, however, may become distorted by a localized external force such as a falling branch or ice. It is a simple matter then to support the damaged area by sliding the nearest bracket to that location and restore the damaged area to reasonably good form.

Figure 5:
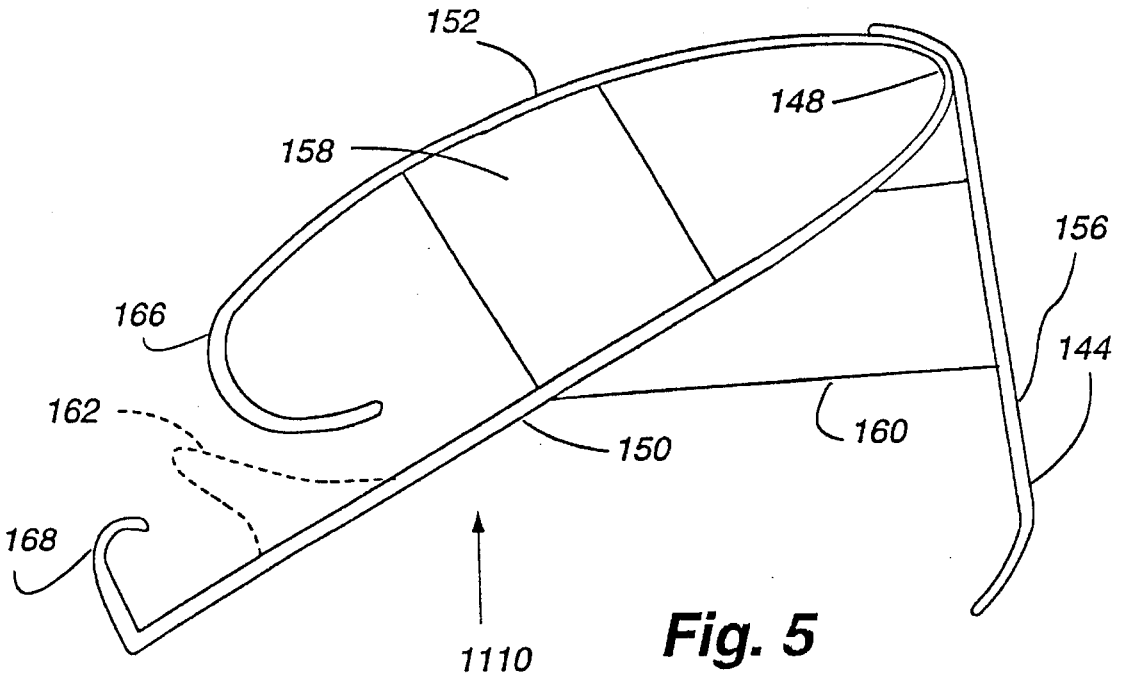
FIG. 5 is a diagrammatic side view of another form supporting bracket of the invention.
Figure 6:
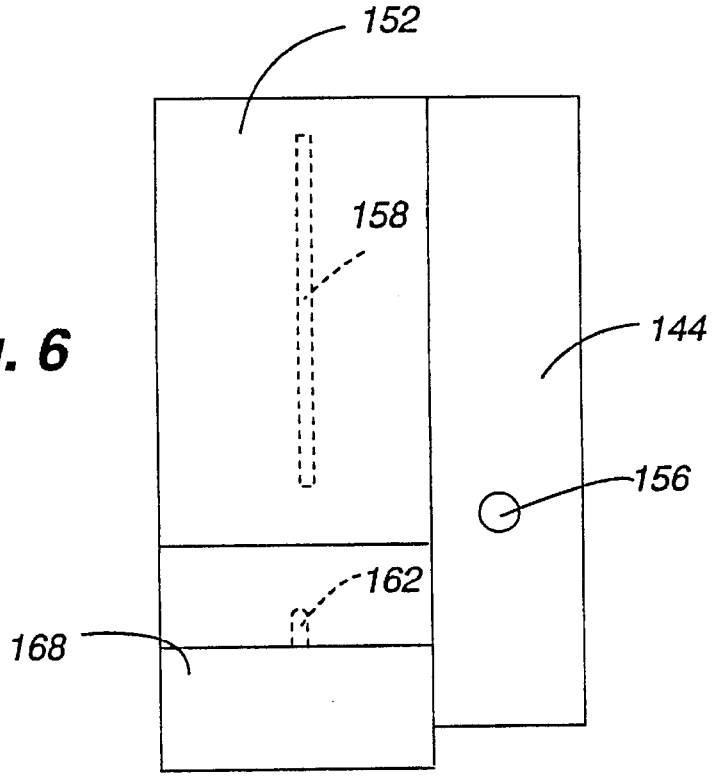
FIG. 6 is a view of the bracket of FIG. 5 rotated 90 degrees clockwise, as seen from direction 6 in FIG. 5.

Referring now to FIGS. 5 and 6, form supporting bracket 140 includes wall 144 which is attached at the junction 148 of walls 150 and 152. Wall 144 includes opening 156 for optionally receiving a fastener to fasten wall 144 in close contact with the back wall of a shielded trough in which bracket 140 is installed with wall 152 in matingly juxtaposed support with the inner side of the shield and wall 150 and with the front ends 166 and 168 of walls 152 and 150, respectively, in matingly juxtaposed support with the front ends of the walls of the shield and trough.

Bracket arm 158 is attached to walls 152 and 150. Bracket arm 160 is attached to wall 150 and 144 and thereby supports the bracket, shield and trough against the back wall of the trough assembly. Optionally, tab 162 extends from wall 150 so that it can be held by fingers, pliers, or other tool through the opening between the front end of the shield and the front end of the trough along the length of the shielded trough for applying force on bracket 140 to move it within the shielded trough along the length of the trough.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. The combination of a shielded trough having a front, a back comprising a back wall for securing said shielded trough to a building, a trough extending from said back wall and having a back end, an upwardly concave bottom and a rearwardly and downwardly curved front end, a shield having a back end, a downwardly concave top with an inner surface and extending from a junction of said back end of said shield and said back wall over said trough to a rearwardly and upwardly curved front end so that leaves are deflected from entering an opening between said front end of said shield and said front end of said wall of said trough to the interior of said shielded trough, and so that water flowing over said shield enters said opening and into said trough; and a bracket comprising a first wall having a front end, a back end, a top surface, an under surface, and formed for being matingly juxtaposed to said inner surface of said top of said shield with the back end of said first wall located at the junction of said back end of said first wall and said back wall, said front end of said first wall formed for being matingly juxtaposed with said rearwardly and downwardly curved front end of said shield, a second wall having a back end, a front end, a top surface and an inner surface extending from a junction of said back end of said second wall and said back end of said first wall to said front end of said second wall, said front end of said second wall formed for being matingly juxtaposed with said rearwardly and downwardly curved front end of said trough.

2. The combination of claim 1, further comprising:

a first bracket arm extending from said inner surface of said second wall to said back wall of said shielded trough.

3. The combination of claim 1, further comprising:

a second bracket arm extending from said top of said second wall to said inner surface of said first wall.

4. The combination of claim 1, further comprising:

a first bracket arm extending from said inner surface of said second wall to said back wall of said shielded trough; and a second bracket arm extending from said top of said second wall to said inner surface of said first wall.

5. The combination of claim 4, further comprising:

said first bracket arm extending from said second wall intermediate said front end and said back end of said second wall.

6. The combination of claim 1, further comprising:

said front end of said first wall ending in a rearward facing upturned bend for engaging said curved front end of said shield.

7. The combination of claim 1, further comprising:

said front end of said second wall ending in a rearward facing downturned bend for engaging said curved front end of said trough.

8. The combination of claim 4 comprising:

said bracket being slideable along the inside of said shielded trough.

9. The combination of claim 4, further comprising:

means integral with said bracket for securing said bracket to said back wall and said building and extending laterally from said bracket so that said securing means is accessible through said opening.

10. The combination of claim 4, further comprising:

said bracket having a third wall extending from the junction of said first and second walls of said bracket along said back end of said shielded trough between said back end of said shielded trough and said first bracket arm.

11. The combination of a shielded trough assembly having a front, a back comprising a back wall for attaching said shielded trough to a building, a trough attached to said back wall and having a front wall, a shield having a front, a top, an inner side, and having a back integral with said back wall and extending forward over said trough so that leaves are deflected from entering an opening between the front of said shield and the front wall of said trough to the interior of said shielded trough, and so that water flowing over said shield enters said opening and into said trough, and;

a bracket comprising a first wall having a front end, a back, an inner side and being in juxtaposed support with the inner side of said shield;

a second wall having a front, a top, an inner side and a back attached to the back of said first wall in the back of said shielded trough, the front of said second wall supporting said front wall of said trough.

12. The combination of claim 11, further comprising:

a bracket arm extending from the inner side of said second wall and resting against the back wall of said shielded trough assembly.

13. The combination of claim 11, further comprising:

a bracket arm extending from the top side of said second wall and resting against the inner side of said first wall.

14. The combination of claim 11, further comprising:

a first bracket arm extending from the inner side of said second wall and resting against the back wall of the shielded trough assembly; and a second bracket arm extending from the top side of said second wall and resting against the inner side of said first wall.

15. The combination of claim 14, further comprising:

said first bracket arm extending from said second wall between and spaced from the front and back of said second wall.

16. The combination of claim 14, further comprising:

said second bracket arm extending from said second wall between and spaced from said front end and said back of said first wall.

17. The combination of claim 11, further comprising:

said bracket being slideable along the inside of said shielded trough by applying sideways force to said bracket.

18. The combination of claim 11, further comprising:

means integral with said bracket for securing said bracket to said wall and said building and extending laterally from said bracket so that said securing means is accessible through said opening.

19. In a shielded trough having a front and a back and comprising a shield having a front and a back and a trough having a front and a back, said shield being superimposed over and spaced from said trough so that said shield deflects leaves and debris on the outer side of said shield from entering the trough by way of a longitudinal space between the front of said shield and the front of said trough and water running over the outer side of said shield is directed by said shield into said trough by way of said longitudinal space, said shielded trough being for use in cooperation with a bracket within said shielded trough, said bracket comprising a first wall adapted for being juxtaposed to the inner side of said shield for supporting said shield and a second wall for supporting said trough, said fronts of said shield and trough ending respectively in a backward facing upturned bend and a backward facing downward bend, said first and second walls of said bracket having bent ends conforming to the bent ends of said fronts of said shield and trough for engaging said front ends of the shield and trough.

* * * * *